US005263342A

United States Patent [19]

Mundstock

[11] Patent Number: 5,263,342

[45] Date of Patent: Nov. 23, 1993

[54] METHOD OF FORMING A MOCK CABLE PATTERN IN KNITTED FABRIC

[76] Inventor: Ricki L. Mundstock, 5209 Tonyawatha Trail, Madison, Wis. 53716

[21] Appl. No.: 956,051

[22] Filed: Sep. 24, 1992

[51] Int. Cl.[5] ..... D04B 1/22; D04B 1/10; D04B 7/24

[52] U.S. Cl. ..... 66/198; 66/169 R; 66/200

[58] Field of Search ..... 66/69, 196, 200, 96 R, 66/60 R, 60 H, 75.1, 169 R

[56] References Cited

U.S. PATENT DOCUMENTS

| | | | |
|---|---|---|---|
| 2,264,016 | 11/1941 | Bialostok . | |
| 2,284,167 | 5/1942 | Ralston | 66/169 |
| 2,427,891 | 9/1947 | Wirtz . | |
| 2,452,707 | 11/1948 | Wirtz . | |
| 2,685,789 | 8/1954 | Marum | 66/200 |
| 2,910,852 | 11/1959 | Herbert et al. . | |
| 4,229,953 | 10/1980 | Warsop . | |

FOREIGN PATENT DOCUMENTS

| | | | |
|---|---|---|---|
| 322589 | 8/1916 | Fed. Rep. of Germany | 66/198 |
| 817859 | 9/1937 | France | 66/200 |

*Primary Examiner*—Clifford D. Crowder
*Assistant Examiner*—John J. Calvert
*Attorney, Agent, or Firm*—Jacobson, Price, Holman & Stern

[57] ABSTRACT

Forming a mock cable pattern in a knitted fabric includes preforming tuck stitches in the fabric, subsequently transferring and placing the tuck stitches on respective preselected needles in an array within which the mock cable pattern is being formed, and knitting the tuck stitches into the fabric. For a mock double cable pattern, two tuck stitches are preformed in the material by outer ones of the needles in the array, so as to subsequently be essentially below these needles. When a fabric row in which the pattern is to begin is reached, knitting then is interrupted, and single eyelet tools are inserted diagonally through openings in the tuck stitches in an upward direction left-to-right and right-to-left, respectively. The tuck stitches then are transferred inwardly and diagonally upward, and placed upon respective ones of the preselected needles, which are rearward for identification purposes, and which then are pulled forward into "hold" knitting positions. Knitting is then resumed, with the tuck stitches being knitted into the fabric to produce a mock cable pattern portion. The process is repeated until the desired length of the mock cable pattern has been formed. A mock single cable pattern is formed in a similar manner using only one tuck stitch and one transfer operation.

27 Claims, 8 Drawing Sheets

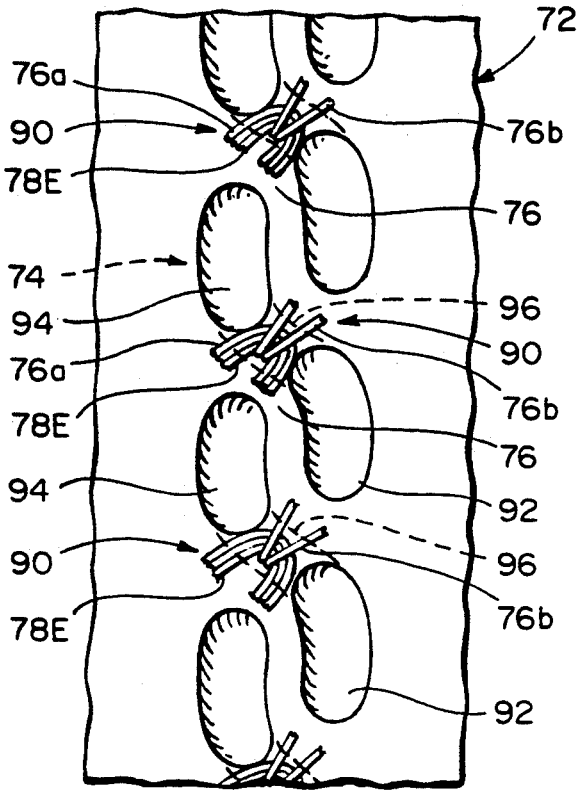
FIG. 7
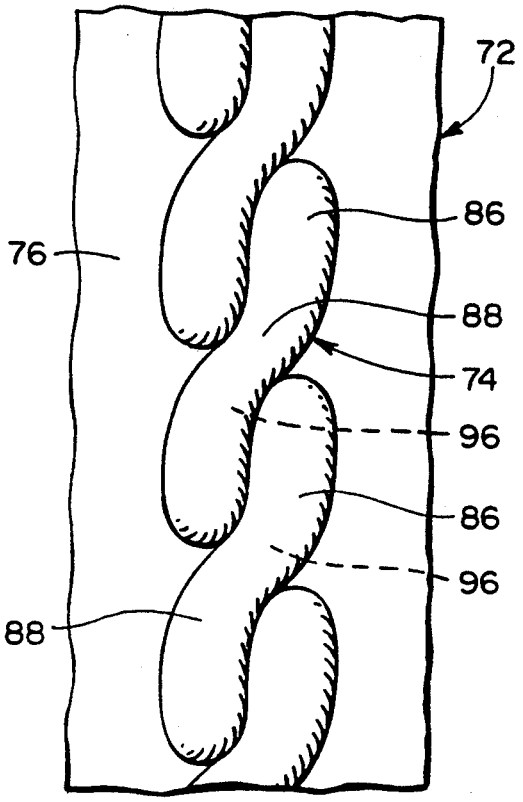
FIG. 8
FIG. 9
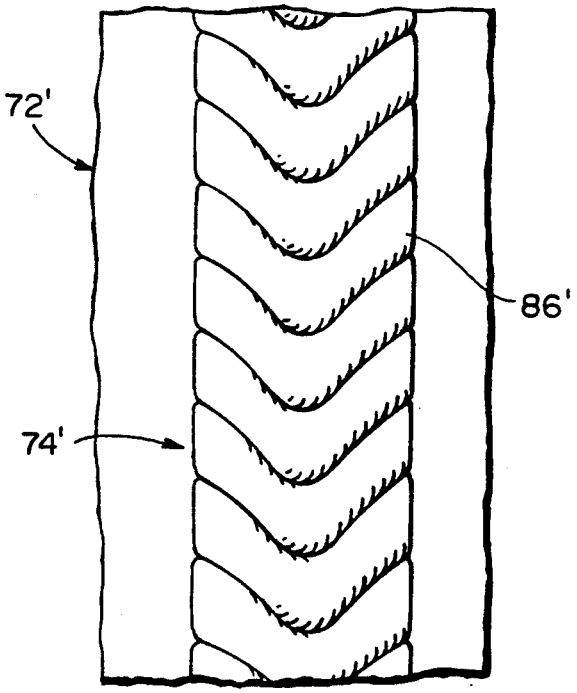

FIG. 10 (SINGLE CABLE & SEED STITCH)
FIG. 10A (Electronics)
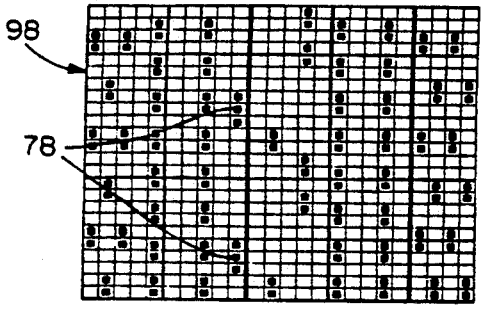
FIG. 10B (Punchcard)
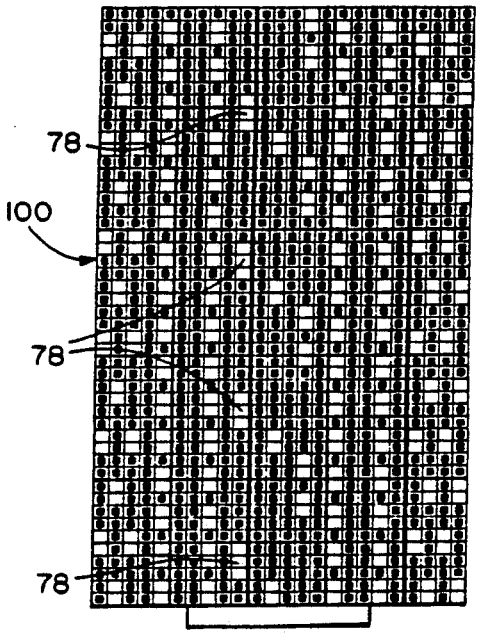
FIG. 11 (DOUBLE CABLE & SEED STITCH)
FIG. 11A (Electronics)
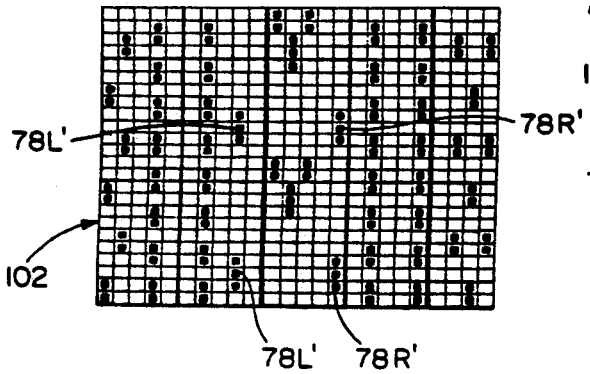
FIG. 11B (Punchcard)
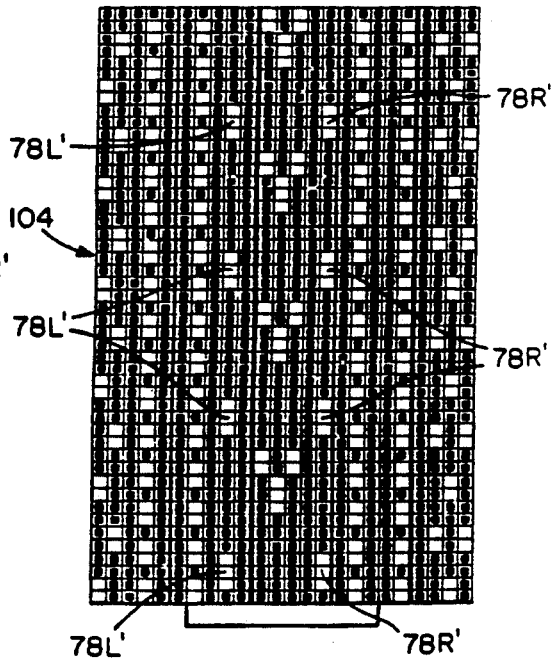

METHOD OF FORMING A MOCK CABLE PATTERN IN KNITTED FABRIC

BACKGROUND OF THE INVENTION

1. Field of the Invention

This invention relates to a method of forming a mock cable pattern in knitted fabric, and more particularly to a method of forming mock single or double cable patterns in knitted fabric utilizing tuck stitches, in a rapid and efficient manner, without removing yarns from, and cross-transferring yarns between, sets of needles during the knitting process.

2. Description of the Prior Art

Knitting machines of a semi-automatic type in which yarns can be knitted in any one of a plurality of desired patterns are well known in the art. In these machines, the machine may be programmed for a desired pattern electronically by computer software, or by the use of a punched card. For example, such a machine is available from Brother International Corporation of Piscataway, N.J., as their Model No. 930 or Model No. 940, respectively.

In this type of machine, by way of example, when it is desired to provide a mock single cable pattern in the knitted fabric, when a preselected number of rows (e.g., 12 or 16) has been knitted and the fabric row (13 or 17) which is to include a first cable cross-over or originating point of the mock single cable pattern, has been reached, knitting is temporarily interrupted. Initially, a yarn loop or stitch on each side of a plurality of yarn loops or stitches which are to be used in forming the mock single cable pattern, then are dropped from their respective needles. The intermediate yarn loops or stitches, which are even in number, such as two sets of three, next are removed from their respective needles and each set of the stitches is transferred to the needles of the other set, by a pair of three-eyed transfer tools. The removed side stitches then are allowed to ladder down, and using a latchet tool, are formed into purl stitches. The knitting operation then is resumed until the fabric row containing a next pattern cross-over point is reached, whereupon the process is repeated, with the process subsequently being repeated at additional cross-over points until a desired length of the mock single cable pattern has been formed.

Other methods of making mock cable patterns in knitted material also are known. For example, U.S. Pat. No. 2,264,016 to M. Bialostok discloses a method of producing a knitted fabric having an area formed to represent a cable by utilizing relatively short needles to knit areas of the knitted fabric with a relatively loose full cardigan stitch, and relatively long needles to knit other areas of the knitted fabric with a jersey tuck stitch so as to obtain a fullness in these latter areas. This patent further discloses the use of tacking to further enhance bulging of the areas knitted by the longer needles.

U.S. Pat. No. 2,427,891 to E. F. Wirtz discloses a method of making a mock cable stitch in a knitted article by first forming an area of stitches which contrast with the stitches of the rest of the fabric (for example, rib knitting), and then centrally constricting this area by gathering a hand stitch which is made horizontally across the contrasting area. Similarly, U.S. Pat. No. 2,452,707 to E. F. Wirtz, describes a method in which machine operations are used to perform the gathering step.

U.S. Pat. No. 2,910,852 to C. N. Herbert et al., like the Bialostok patent, discloses the forming of a mock cable design utilizing short floats to produce projecting portions in the fabric, and subsequent tacking to enhance and/or to create a degree of projection, and/or to form different types of cable patterns in the fabric.

U.S. Pat. No. 4,229,953 to D. H. Warsop discloses a stitch bonded fabric which is made on a two-guide-bar machine with the front bar knitting pillar stitches and the back bar forming stitches and/or laid-in sections and/or floats of thread extending over at least two wales of the front bar system and repeating over not less than four courses or rows, with one effect which can be produced by the disclosed method being a simulated raised cable stitch formation. In particular, it is stated that a single, or preferably a double missed thread wale on the front bar system is crossed by floats of the back bar system, with tension in the floats pulling in the front bar pillar stitch wales on either side of the missed thread wale, which bunches up the filling in between so that it stands upward of the adjacent pillar stitched regions, while the floats extending diagonally across the raised filling impart a cable or twisted appearance.

Accordingly, a need exists for an improved method of forming mock cable patterns in knitted fabric which can be accomplished in a simple, rapid and efficient manner, and a primary purpose of this invention is to provide such a method.

SUMMARY OF THE INVENTION

In general, a method of forming a portion of a mock cable pattern in a knitted fabric, comprises forming at least one tuck stitch in the fabric in advance of a preselected fabric row in which the portion of the mock cable pattern is to begin, and then knitting the fabric until the preselected fabric row has been reached. The tuck stitch then is transferred to placed on top of a yarn loop on a preselected needle in that row, and subsequently knitted into the fabric, to form the portion of the mock cable pattern.

More specifically, the tuck stitch is transferred to the preselected needle on the back of the knitted fabric. Further, prior to the tuck stitch transfer operation, the fabric has been knitted so that the preselected needle and the tuck stitch are displaced relative to one another in first and second perpendicular directions. This displacement is a result of the tuck stitch having been formed on a different needle so that the tuck stitch subsequently is located in the first perpendicular direction substantially in alignment with that needle, which then also has a yarn loop thereon. Further, the displacement of the preselected needle and the tuck stitch in the second perpendicular direction usually encompasses at least one other intervening needle having a yarn loop thereon.

The transfer of the tuck stitch is accomplished with a transfer tool in which the tool is inserted diagonally through openings in the tuck stitch in a first direction, and the tuck stitch then is transferred diagonally to the respective preselected needle in the first direction, and placed upon the yarn loop on the needle as an enlarged tuck stitch. A mock single cable pattern may be formed utilizing left-hand and right-hand sets of two needles each on opposite sides of a zero or central point, with a formed tuck stitch being essentially in alignment with the second needle in the left-hand set, and with the tuck stitch being transferred to and placed upon the yarn loop on the second needle in the right-hand set. Similarly, a mock double cable pattern may be formed of left-hand and right-hand sets of four needles on opposite sides of a zero or central point, with the second needle to the left of the central point being the preselected needle in the left-hand set, to which a left-hand tuck stitch is transferred, and the first needle to the right of the zero point being the preselected needle in the right-hand set, to which a right-hand tuck stitch is transferred.

BRIEF DESCRIPTION OF THE DRAWINGS

FIG. 7 is a schematic back view of a portion of a mock single cable pattern knitted in accordance with the steps of FIGS. 4A, B and C;

FIG. 8 is a schematic front view of the portion of the mock single cable pattern shown in FIG. 7;

FIG. 9 is a schematic front view, similar to FIG. 8, of the mock double cable pattern formed by the steps of FIGS. 5A, B and C;

FIGS. 10A and 10B, respectively, are illustrations of an electronic control pattern and a punch card control pattern for forming a mock single cable pattern with a seed stitch, in accordance with the invention, using the machine of FIG. 1; and FIGS. 11A and 11B, respectively, are illustrations of an electronic pattern and a punch card control pattern for forming a mock double cable pattern with a seed stitch, in accordance with the invention, using the machine of FIG. 1.

DETAILED DESCRIPTION OF DISCLOSED EMBODIMENTS

Figure 1:
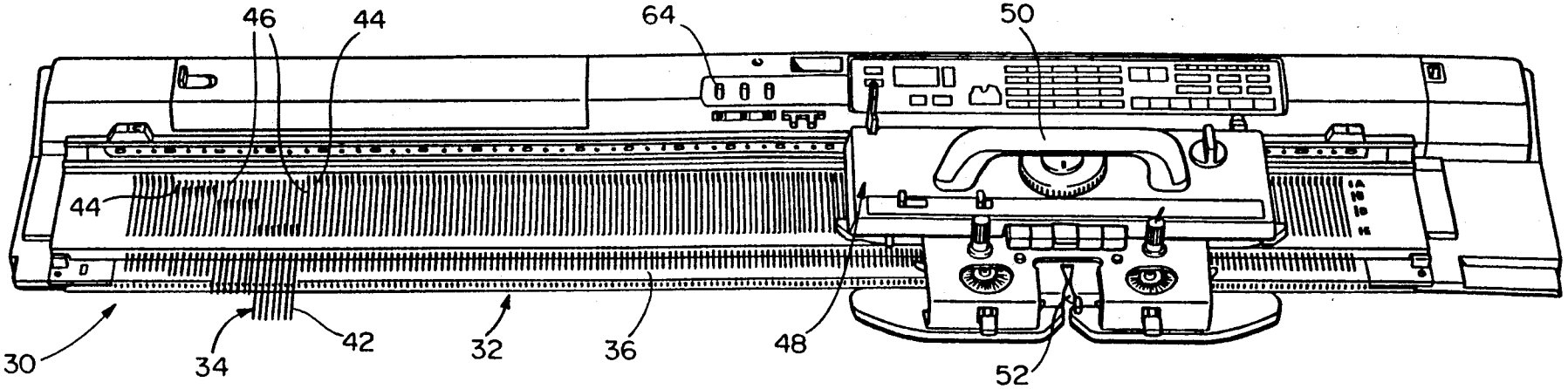
FIG. 1 (PRIOR ART)
FIG. 1 is a schematic essentially plan view of a known type of knitting machine by which the disclosed inventive method may be practiced.

Referring to FIG. 1, a schematic representation of a semi-automatic knitting machine 30 which may be utilized in practicing the invention, is disclosed, such a machine being that available from Brother International Corporation of Piscataway, N.J. as their Model No. 930 or Model No. 940, respectively. Since the structure of the machine 30 and the general manner of its operation are known in the art, the machine has been shown only generally and is described only generally herein. It also is to be understood that various other machines which are known in the art may be used in practicing the invention.

The machine 30 comprises a needle bed assembly 32 having an array of knitting needles 34 slidably supported therein and projecting forwardly therefrom above a suitably marked needle position indicator bar 36. Each needle 34 is of known construction, including a hook 38 (FIG. 3) at its outer end, an inwardly spaced pivoted latch 40 (FIG. 3), a stem 42, a reverse-folded butt portion 44 (FIG. 1) and a shank (not shown), with the butt portion being movable in a respective slot 46 (FIG. 1) in the needle bed assembly 32 and projecting upwardly therefrom, for alignment and needle movement purposes.

The machine 30 further includes a reciprocating knitting carriage 48 having an upwardly projecting handle 50 by which an operator may move the carriage back and forth along the needle bed assembly 32 to cause knitting of yarns in a knitting operation. For this purpose, the machine 30 is of a type which may be electronically controlled by a computer, or by a punched card reader, neither of which is shown, to cause the carriage, by an internal mechanism, also not shown, to engage the needle butt portions 44 so as to cause selective advancement and retraction of the needles, depending upon the pattern being knitted. As a result, during a knitting operation, yarn which is fed downward from an elevated supply (not shown), and which is suitably threaded through a yarn feeder 52 in the reciprocating carriage 48, is knitted to form a fabric having a desired pattern in a known manner.

Figure 2:
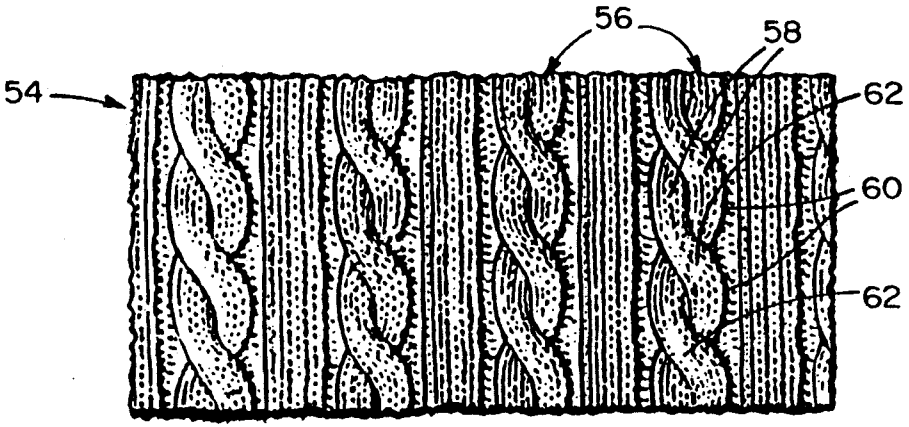
FIG. 2 (PRIOR ART)
FIG. 2 is a plan view of a portion of a knitted fabric or material comprising a plurality of spaced known mock single cable patterns.

FIG. 2 is a representation of a portion of a knitted fabric or material 54 which includes a plurality of spaced known mock single cable patterns 56 which may be emulated by the subject invention. It is seen that each mock single cable pattern 56 includes a pair of what appears to be intertwined serpentine cable portions 58 with each of the cable portions alternately reversing direction essentially at maximum divergence points 60, and crossing over and/or under one another at intermediate cross-over points 62.

Figure 3:
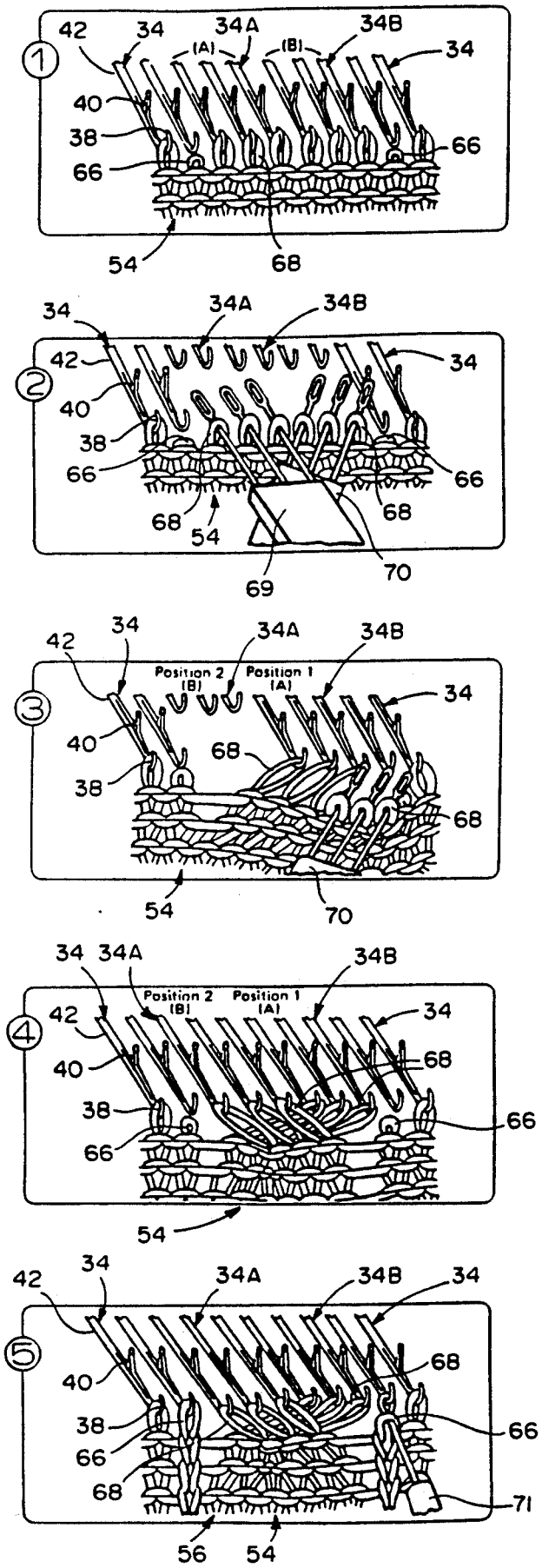
FIG. 3 (PRIOR ART)
FIG. 3 is a series of schematic views illustrating steps in a known prior art method of forming the mock single pattern of FIG. 2.

Referring to FIG. 3, there is disclosed schematically five steps by which each of the knitted mock single cable patterns 56, as shown in FIG. 2, presently is formed in the prior art using, for example, the machine 30, which is of a type in which the back of the fabric being knitted faces an operator, while the front of the knitted fabric faces away from the operator. In the example shown, the mock single cable pattern 56 includes stitches formed by two sets of three of the needles 34, designated 34A and 34B, respectively, although a lesser or greater number of needles can be used.

More specifically, after an operator had completed the knitting of preselected number of rows of the fabric 54, such as twelve or sixteen, as indicated on a row counter 64 (FIG. 1) of the machine 30, by traversing the programmed carriage 48 back and forth on the needle bed assembly 32, and had reached a row (e.g., 13 or 17) in which an initial cable cross-over point 62 in one or more of the mock single cable patterns 56 was to originate, the operator stopped knitting and proceeded through the steps 1–5 illustrated in FIG. 3 for each mock single cable pattern to be formed. Thus, referring to step 1 of FIG. 3, using a single eyelet tool, not shown, the operator initially dropped one yarn loop or stitch 66 on either side of mock single cable pattern yarn loops or stitches 68.

Referring to step 2, using a pair of three-eyed transfer tools 69 and 70, the operator then removed the stitches 68 from the needles 34A with one tool, and the stitches from the needles 34B with the second tool. In step 3, the operator then transferred the stitches 68 which were on the needles 34A, to the needles 34B, following which, with reference to step 4, the stitches which were on the needles 34B, were transferred to the needles 34A, thus reversing the positions of the stitches on their respective needles. Referring to step 5, the dropped stitches 66 on either side of the mock single cable pattern 56 then were permitted to ladder down, and using a latchet tool 71, were reformed into purl stitches.

The foregoing procedure then was followed for each additional mock single cable pattern 56 which was to be formed in the fabric 54, whereupon knitting was resumed for the next preselected number of twelve or sixteen rows, until the next cable cross-over point 62 was reached, whereupon knitting was stopped and the stitch dropping, stitch transfer and purling process was repeated for each mock single cable pattern. Knitting then was again resumed for another set of rows until the next cable crossover point 62 was reached, at which time the process was again repeated, with the alternate knitting and stitch dropping, transferring and purling steps being repeated until the desired length of the mock single cable patterns 56 had been completed.

Figure 4A:
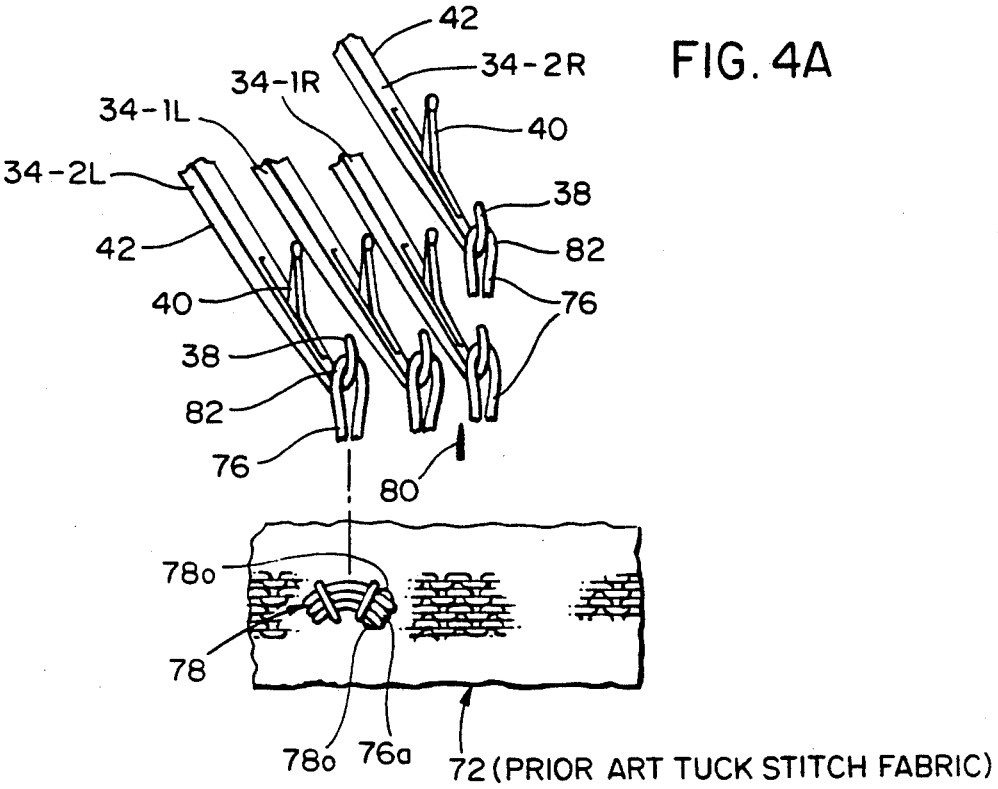
FIG. 4A is a schematic view illustrating steps in the forming of a mock single cable pattern in accordance with the subject invention.

In contrast, with reference to FIG. 4A, by the method of the subject invention, a fabric or material 72 having a mock single cable pattern 74, as illustrated in FIGS. 7 and 8, which has essentially the same appearance as the mock single cable pattern 56 depicted in FIG. 2, can be produced from yarns 76 in a simpler, faster and more efficient manner. In general, the method involves forming "tuck stitches" 78 (a tuck stitch being of a known type in which from two to four yarns are collected on a needle before being knitted into the fabric, and only one of which is shown), in preselected positions with respect to respective needle arrays in advance of a fabric row in which mock single cable patterns 74 are to begin, and subsequently transferring the tuck stitches to respective needles in the array, and then knitting the transferred tuck stitches into the fabric 72. By repeating this procedure at periodic intervals during the knitting process, the mock single cable pattern 74, as illustrated in FIGS. 7 and 8, is achieved.

More specifically, by way of illustration, referring to the schematic representation of FIG. 4A, initial steps in the forming of one of the mock single cable patterns 74 using two sets of two of the knitting needles 34, is disclosed. The knitting needles are located on opposite sides of a central or zero point 80, and are designated 34-1R, 34-2R, 34-1L and 34-2L, respectively.

Figure 6:
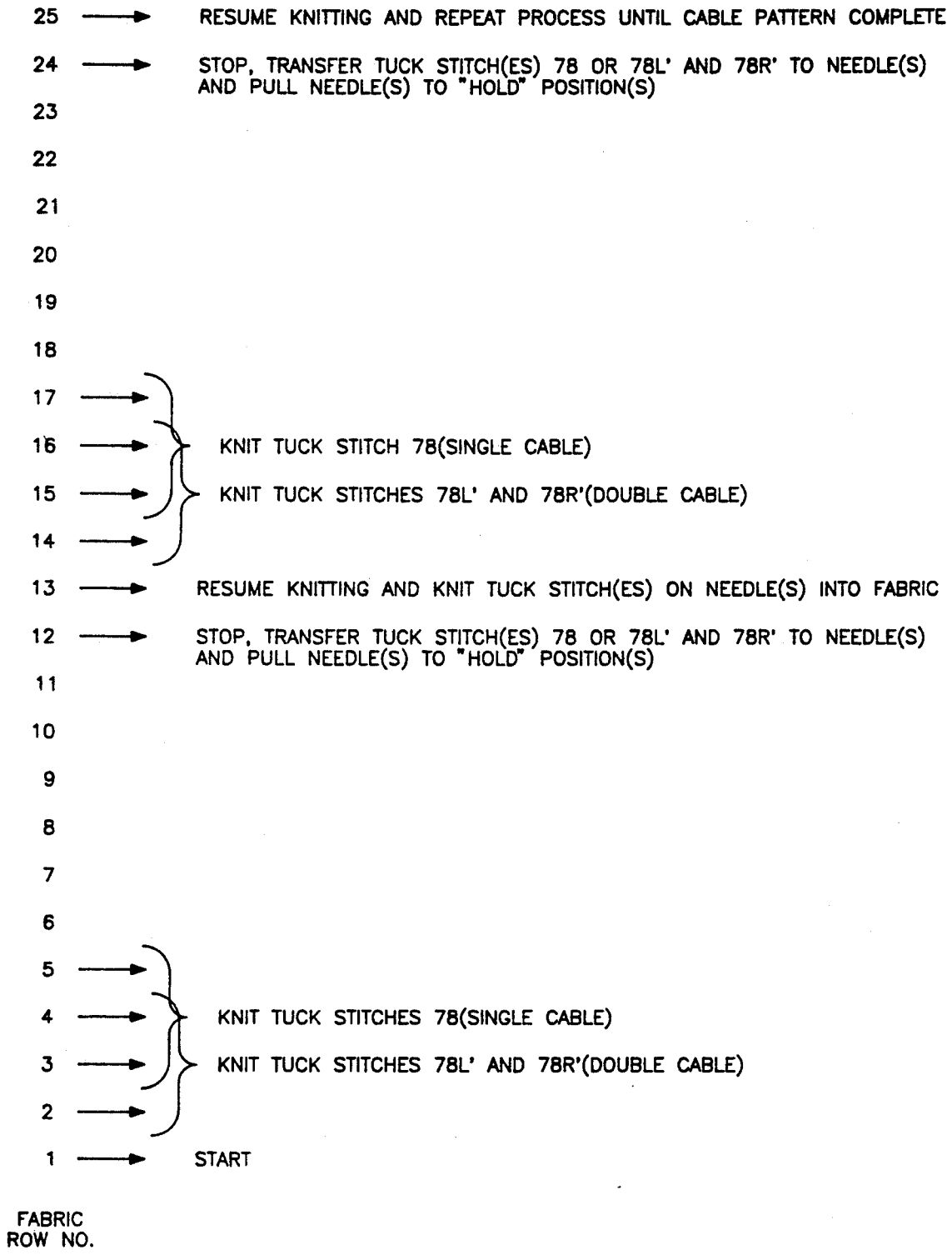
FIG. 6 is a diagram further illustrating the sequence of steps shown in FIGS. 4A, B and C, and 5A, B and C, in a fabric knitting operation.

Further by way of illustration, in forming a plurality of the mock single cable patterns 74, a preselected number (e.g., twelve) of fabric rows of a tuck stitch pattern is initially knitted, as illustrated by the diagram in FIG. 6. The forming of the tuck stitch pattern, in which some tuck stitches (not shown) may be formed for visual effect, is accomplished in a normal manner, except that, in accordance with the subject invention, the tuck stitches 78 are formed in preselected positions with respect to locations at which each mock single cable pattern 74 is to originate. For example, in FIG. 4A, the tuck stitch 78 has been previously formed in the fabric 72 by the needle 34-2L using three of the yarns 76 in rows 3, 4 and 5, as illustrated in FIG. 6, so that this tuck stitch includes three collected yarns (designated **76*a* in FIGS. 4A–C and 7) now is essentially vertically below this needle, which is forward and has a respective yarn stitch or loop 82 thereon. (The rows used to form the tuck stitch 78 may be varied to achieve different configurations of the mock single cable pattern 74.) The machine 30 also has been programmed so that when twelve rows of fabric have been knitted and fabric row 13 has been reached, a preselected needle, in this case the needle 34-2R is in a rearward position (to facilitate identification) with a yarn loop 82 thereon, and with the remaining two needles 34-1L and 34-1R in forward positions also with yarn loops 82 thereon. (For a reversed pattern, the functions of the needles 34-2L and 34-2R would be reversed.) Thus, it is seen that the preselected needle 34-2R and the preformed tuck stitch 78** are in displaced relationship relative to one another in first (vertical) and second (horizontal) directions, in a diagonal relationship.

Figure 4B:
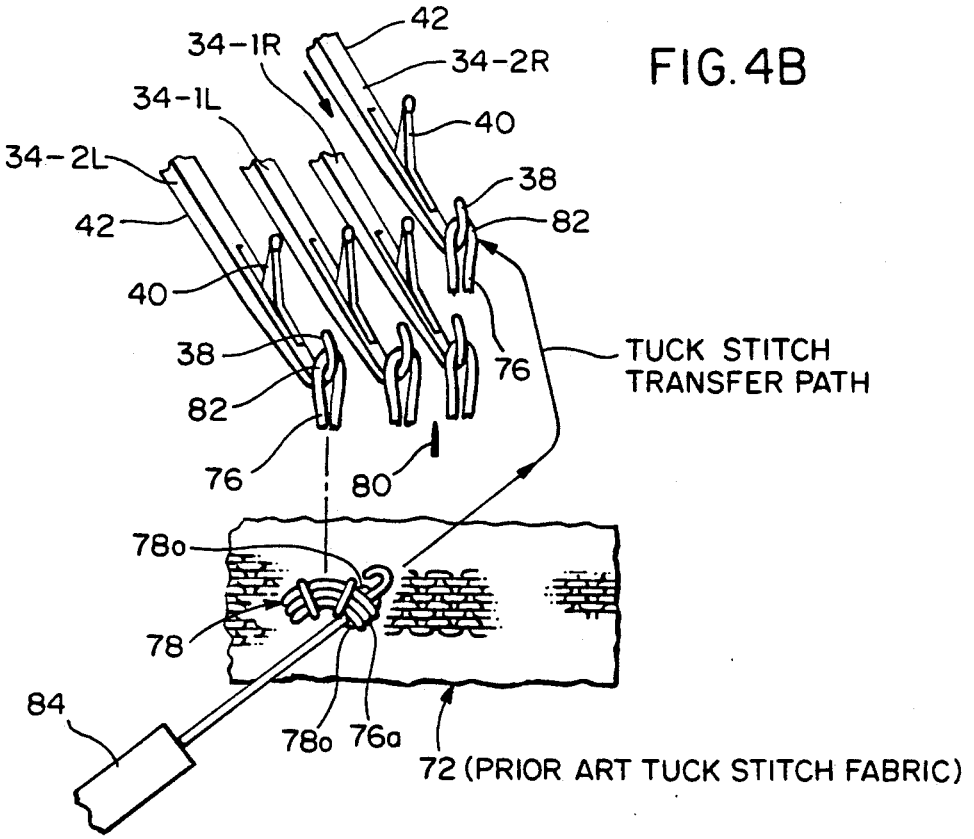
FIG. 4B is a schematic view similar to FIG. 4A, illustrating subsequent steps in the forming of the mock single cable pattern.

As viewed in FIG. 4B, utilizing a single eyelet tool 84, the operator then inserts the tool through diagonally opposed openings **78*o* in the tuck stitch 78 upward and from left to right, transfers the tuck stitch diagonally in the same direction past the yarn loops 82 on the needles 34-1L and 34-1R, toward the rearward needle 34-2R, and places the tuck stitch upon the yarn loop 82 on this needle as an "enlarged tuck stitch" 76E (see FIG. 4C), as indicated by the arrow. (As in the selection of the fabric rows used to form the tuck stitch 78, the number of needles 34 and the needle to which the tuck stitch is transferred can be varied to achieve different configurations of the mock single cable pattern 74.) Then, the operator manually pulls the needle 34-2R forward into a "hold" knitting position, with the enlarged tuck stitch 78E thereon, as shown by solid lines in FIG. 4C**.

After all of the originating points for any other mock single cable patterns 74 have been processed as shown in FIGS. 4A B and C, knitting is resumed to knit in the enlarged tuck stitches 78E as the next row 13 of the fabric is knitted, and knitting then is continued until twelve more rows of the fabric 72 have been completed, as illustrated in FIG. 6. The foregoing tuck stitch-transfer step then is repeated, using tuck stitches (not shown) which have been preformed by respective ones of the needles 34-2L in rows 15, 16 and 17. Knitting then is again resumed with this procedure being repeated, as necessary, until the desired mock single cable patterns 74 have been completed.

Thus, with reference to FIG. 7, it is seen that the yarns **76*a* of each of the transferred and knitted-in enlarged tuck stitches 78E have become knitted into the fabric 72 on the back thereof by respective fabric yarns 76*b*. As a result, these tuck stitches 78E have produced raised undulating or partial serpentine portions or segments 86 on the front of the fabric 72, as shown in FIG. 8, in which each undulating segment appears visually to cross under the next-formed undulating or partial serpentine segment, thereby producing the mock single cable pattern 74 having simulated cross-over points 88. In this connection, with reference to the back of the fabric 72 as illustrated in FIG. 7, each knitted-in tuck stitch 78E, including its yarns 76*a* and the yarns 76*b*, produce a fabric intermediate "bridge" portion 90 located between two spaced fabric recess portions 92 and 94 interconnected by an intermediate "tunnel" portion 96** (further schematically illustrated by broken lines)

extending under the "bridge" portion, with the recess portions and the "tunnel" portion producing the respective undulating raised cable segment 86 on the front of the fabric, as shown in FIG. 8.

Figure 5A:
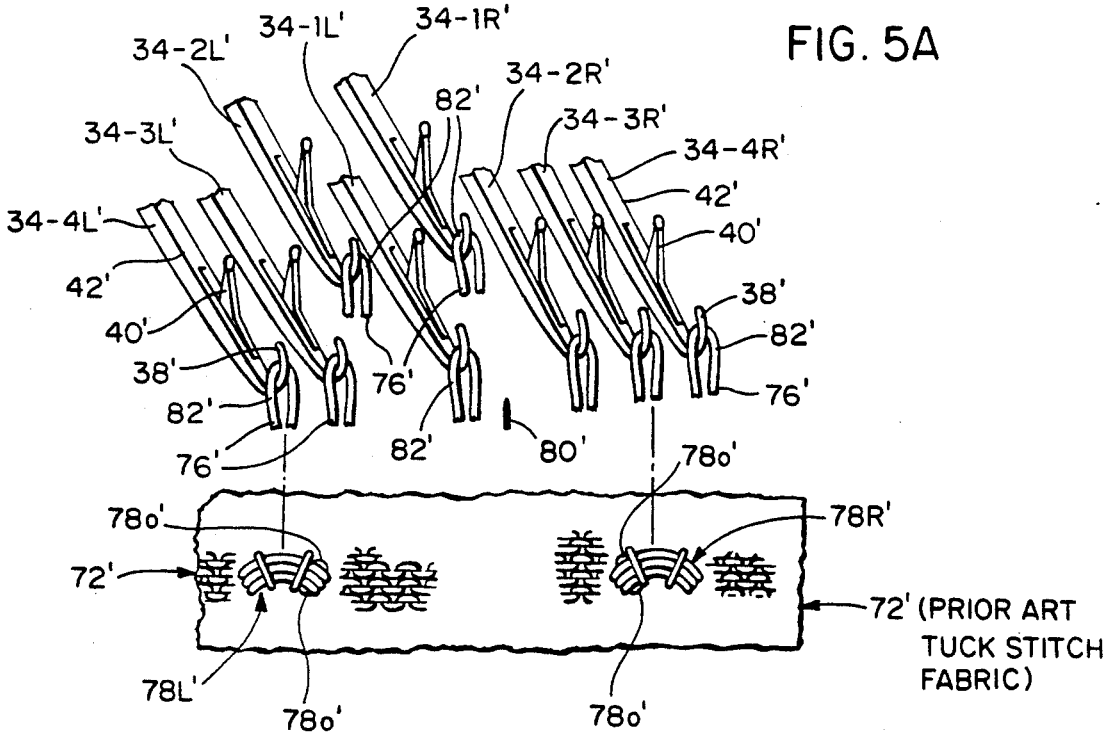
FIG. 5A is a schematic view illustrating steps in the forming of a mock double cable pattern in accordance with the subject invention.
Figure 5B:
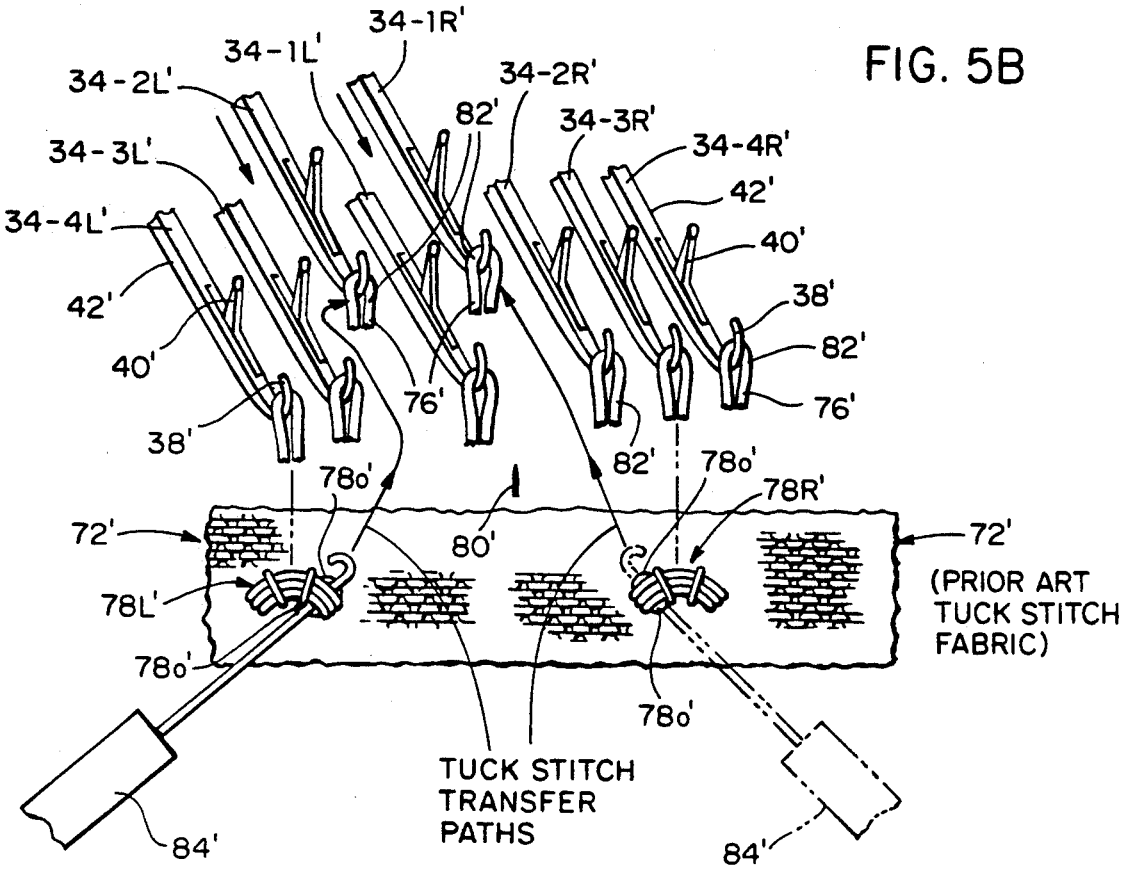
FIG. 5B is a schematic view similar to FIG. 5A, illustrating subsequent steps in the forming of the mock double cable pattern.
Figure 5C:
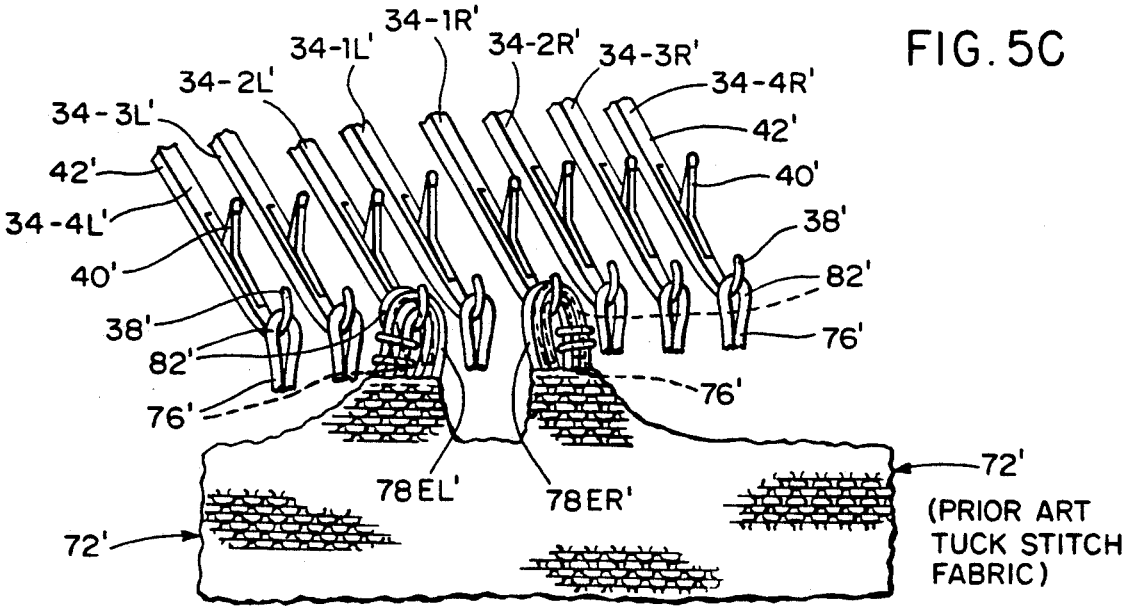
FIG. 5C is another schematic view, similar to FIGS. 5A and 5B, further illustrating steps in accordance with the forming of the mock double cable pattern.

FIGS. 5A, 5B and 5C schematically illustrate the steps used in forming a fabric 72' having a mock double cable V-shaped pattern 74' in accordance with the invention, as shown in FIG. 9, comprising a series of vertical raised V-shaped fabric portions or segments 86'. In this instance, left-hand and right-hand sets of four knitting needles, on opposite sides of a central zero point 80' and designated 34-1R', 34-2R', 34-3R', 34-4R', 34-1L', 34-2L', 34-3L' and 34-4L', are utilized.

Further, a tuck stitch 78L' has been previously formed in the fabric 72' by the needle 34-4L' using three of the yarns 76', by way of example, in rows 2, 3 and 4, as illustrated in FIG. 6, so that this tuck stitch now is essentially below this needle, which is forward and has a respective yarn loop 82' thereon. Similarly, in spaced relationship to the tuck stitch 78L', a second tuck stitch 78R' has been previously formed using the same three yarns 76' in the fabric rows 2, 3 and 4, by the needle 34-3R', so as to now be essentially below this needle, which also now is forward and has a respective yarn loop 82' thereon. The machine 30 also has been programmed so that the needles 34-2L' and 32-1R' are back or rearward (to facilitate identification) and have yarn loops 82' thereon, whereas the remaining needles 34-1L', 34-3L', 34-2R' and 34-4R' also are forward and have respective yarn loops 82' thereon. Thus, the tuck stitches 78L' and 78R' are spaced from their respective rearward needles 34-2L' and 34-1R' in first and second perpendicular directions, in this instance, vertically and horizontally, in a diagonal relationship.

Next, referring to FIGS. 5B and 5C, the operator inserts a single eyelet tool 84' through diagonally opposed openings **78*o*' in the left hand tuck stitch 78L' upward and from left to right as shown in FIG. 5B, transfers the tuck stitch diagonally upward to the right past the yarn loop 82, on the needle 34-3L', places the tuck stitch as an "enlarged tuck stitch" 78EL' (see FIG. 5C) upon the yarn loop 82' on the rearward needle 34-2L', and then manually pulls that needle forward into a "hold" knitting position as shown in solid lines in FIG. 5C. Similarly, the operator then inserts the single eyelet tool 84' through openings 78*o*' in the right-hand tuck stitch 78R upward and from right to left, transfers the tuck stitch diagonally upward to the left past the yarn loop 82' on the needle 34-2R', and places this tuck stitch as an "enlarged tuck stitch" 78ER' (see FIG. 5C) on the yarn loop 82' on the rearward needle 34-1R', and then manually pulls this needle forward into its "hold" knitting position as shown in solid lines in FIG. 5C**.

After the steps illustrated in FIGS. 5A, B and C have been completed for any other mock double cable pattern 74' to be formed, referring to FIG. 6, knitting of the fabric 72' is again resumed with the enlarged tuck stitches 78EL' and 78ER' on the needles becoming knitted into the fabric as the next row 13 of the fabric is knitted, as illustrated in this figure. Then, in fabric rows 14, 15 and 16, new ones of the tuck stitches 78L' and 78R' are formed. Knitting then proceeds in a normal manner until fabric row 24 is reached, whereupon knitting again is temporarily interrupted and the tuck stitch-to-needle transfer process is again repeated. Knitting then is again resumed for the fabric row 25 as previously described, with the alternate knitting, stopping and tuck stitch-to-needle transfer steps being repeated until formation of the desired mock double cable patterns 74' have been completed, with the front side of the fabric 72' appearing as illustrated in FIG. 9, and comprising the vertical series of raised V-shaped fabric portions or segments 86'.

As noted previously, in forming a tuck stitch pattern, the machine 30 functions in its normal manner, the only requirement being that in accordance with the subject invention, the tuck stitches 78, or 78L' and 78R', be formed in preselected locations vertically and horizontally with respect to certain of the needles 34 or 34', in order to be able to form the mock single cable pattern 74 or the mock double cable pattern 74', respectively, as above described. This can be accomplished by either programming the machine 30 so that it is electronically controlled by the above-mentioned computer (not shown), or by controlling the machine using a punch card which is read by the above-mentioned punch card reader (also not shown).

For example, FIG. 10A discloses a suitable electronic control pattern 98 for forming the mock single cable pattern 74 as illustrated in FIGS. 7 and 8, with a seed stitch, not shown, wherein the locations of normal knit stitches in the fabric 72 are represented by white squares and the location of the tuck stitches 78 and other tuck stitches for visual effect, are represented by black squares. The electronic pattern 98 is input into the machine 30 from a disc, where a disc drive is available, or manually, in a known manner.

In the alternative, with reference to FIG. 10B, a punch card 100, in which white squares represent the tuck stitches 78 and other tuck stitches for visual effect, and black squares represent normal knit stitches, is shown for the same purpose. In like manner, FIGS. 11A and 11B, respectively, illustrate an electronic pattern 102 and a punch card 104, which may be utilized for forming the mock double cable pattern 74' as illustrated in FIG. 9, with a seed stitch, not shown.

Figure 4C:
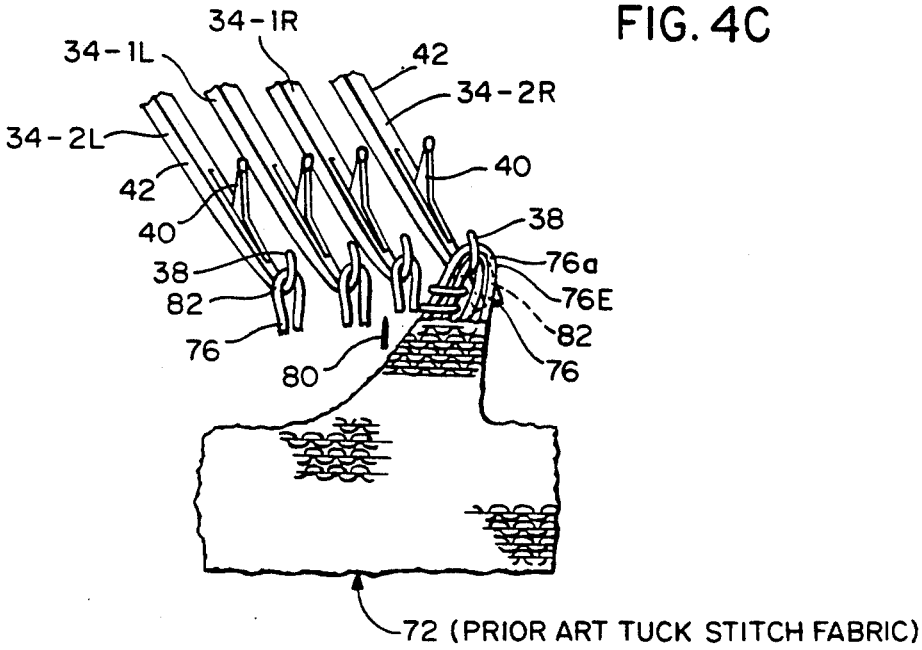
FIG. 4C is a schematic view similar to FIGS. 4A and 4B, further illustrating steps in the forming of the mock single cable pattern.

In summary, a new and improved method of forming a mock single cable pattern 74 (FIGS. 7 and 8) or a mock double cable pattern 74' (FIG. 9), which is simpler, more rapid and more efficient than prior known methods of forming cable patterns, has been disclosed. In this connection, with reference to the mock single cable pattern 74, as is illustrated in FIG. 6, the disclosed method involves the preforming of the tuck stitches 78 in preselected positions by using, for example, the needle 34-2L in FIG. 4A, for each mock single cable pattern 74 being formed, during an initial knitting operation. Subsequently, knitting is interrupted and each of the tuck stitches 78 is transferred to and placed upon the yarn loop 82 on its respective retracted (for identification) needle 34-2R in a single transfer step, as the enlarged tuck stitch 78E, and this needle then is manually pulled forward into its "hold" knitting position, as illustrated in FIG. 4C. Knitting then is resumed, with the transferred tuck stitches 78E becoming knitted into the fabric 72. During this subsequent knitting process, the tuck stitch preforming, transfer and knitting-in steps are repeated until the desired lengths of the mock single cable patterns 74 are completed. Thus, the steps of dropping, laddering and forming stitches into purl stitches, together with the cross-transfer of multiple stitches between needles, to form the mock single cable pattern 56 of FIG. 2 in accordance with the prior art method shown in FIG. 3, is eliminated, resulting in a simpler, more rapid and more efficient knitting operation. Further, the mock double cable pattern 74', as illustrated in FIG. 9, may be formed, as illustrated in FIGS. 5A, B and C and FIG. 6 in a similar manner.

It is to be understood that various other modifications, additions and alternative designs are, of course, possible in light of the above teachings. Therefore, it also should be understood at this time that within the scope of the appended claims, the invention may be practiced otherwise than as specifically described hereinabove.

What is claimed is:

1. A method of forming a portion of a mock cable pattern in a knitted fabric while knitting the fabric, which comprises the steps of:

forming at least one tuck stitch in the fabric in advance of a preselected fabric row in which a portion of the mock cable pattern is to originate;

further knitting the fabric until the preselected fabric row is reached;

transferring the tuck stitch to, and placing the tuck stitch on, a preselected knitting needle in said preselected fabric row; and then knitting the preselected fabric row to knit the tuck stitch into the fabric and to form the portion of the mock cable pattern.

2. The method as recited in claim 1, wherein the tuck stitch is transferred to and placed upon the preselected needle on a back side of the fabric.

3. The method as recited in claim 1, wherein prior to the tuck stitch transfer step, the preselected needle and the tuck stitch are in displaced relationship relative to one another in first and second perpendicular directions.

4. The method as recited in claim 3, wherein:

the tuck stitch is formed by a different preselected knitting needle so that the tuck stitch subsequently is located in the first perpendicular direction essentially in alignment with said different preselected needle; and the displacement of the preselected needle on which the tuck stitch is placed and said different preselected needle on which the tuck stitch is formed, in the second perpendicular direction, encompasses at least one other intervening needle.

5. The method as recited in claim 1, in which the fabric is knitted so that when the preselected fabric row is reached, the preselected needle on which the tuck stitch is placed, is disposed in a rearward position with respect to other needles for identification purposes.

6. The method as recited in claim 5, in which the preselected needle is pulled forward to a knitting position after the tuck stitch has been placed thereon.

7. The method as recited in claim 1, wherein the mock cable pattern is a single cable pattern and which further comprises:

inserting a transfer tool diagonally through openings in the formed tuck stitch in a preselected direction;

transferring the tuck stitch to the preselected needle in the preselected direction, and placing the tuck stitch on the preselected needle; and then knitting the tuck stitch into the fabric.

8. The method as recited in claim 7, wherein the tuck stitch is transferred to the preselected needle past at least one intervening needle.

9. The method as recited in claim 8, wherein the tuck stitch is transferred to the preselected needle past two intervening needles.

10. The method as recited in claim 7, which further comprises repeating the tuck stitch forming, transferring, placing and knitting-in steps until a desired length of the mock single cable pattern has been formed.

11. The method as recited in claim 10, wherein the tuck stitch is transferred to and placed upon the preselected needle at a simulated cable cross-over point.

12. The method as recited in claim 1, wherein the portion of the mock cable pattern is a portion of a double cable pattern, and which further comprises:

forming at least two of the tuck stitches in the fabric in spaced relationship and in advance of the preselected fabric row in which the portion of the double cable pattern is to originate;

transferring the tuck stitches to, and placing the tuck stitches on, respective preselected needles when the preselected fabric row is reached; and then knitting the tuck stitches into the fabric to form the portion of the mock double cable pattern.

13. The method as recited in claim 12, wherein the tuck stitches are transferred to and placed upon their respective preselected needles on a back side of the fabric.

14. The method as recited in claim 12, which further comprises:

inserting a transfer tool diagonally through openings in one of the tuck stitches in one direction, and transferring the tuck stitch in the one direction to its respective preselected needle; and inserting a transfer tool diagonally through openings in the other tuck stitch in an essentially opposite direction, and transferring the other tuck stitch in the essentially opposite direction to its respective preselected needle.

15. The method as recited in claim 14, wherein the tuck stitches and their respective needles are displaced prior to the tuck stitch transfer steps relative to one another in first and second perpendicular directions.

16. The method as recited in claim 15, wherein:

the tuck stitches are formed by different respective preselected needles;

the formed tuck stitches subsequently are located in the first perpendicular direction essentially in alignment with their respective ones of the different preselected needles; and the displacement of the different ones of the preselected needles on which the tuck stitches are formed and their respective preselected needles on which the tuck stitches are placed, as measured in the second perpendicular direction, encompasses at least one other intervening needle.

17. The method as recited in claim 16, wherein:

the spacing of the tuck stitches in the second perpendicular direction encompasses left-hand and right-hand sets of needles located on opposite sides of a central zero point the tuck stitch which is transferred in the one direction initially is located on one side of the central zero point and is placed on its respective preselected needle on the one side of the central zero point; and the tuck stitch which is transferred in the opposite direction is initially located on an opposite side of the central zero point and is placed on its respective preselected needle on said opposite side of the central zero point.

18. The method as recited in claim 17, wherein each set of needles includes at least four needles, with the needle in the set of needles on the one side of the central zero point on which the tuck stitch which is transferred in the one direction is placed, is the second needle from the central zero point, and the needle in the set of needles on the opposite side of the central zero point on which the tuck stitch which is transferred in the opposite direction is placed, is the first needle from the central zero point.

19. The method as recited in claim 18, wherein the tuck stitches are transferred to and placed upon their respective needles on a back side of the material.

20. The method as recited in claim 19, which further comprises repeating the tuck stitch forming, transferring and placing steps, the fabric portion knitting step and the step of knitting the tuck stitches into the fabric, until a desired length of the mock double cable pattern has been formed.

21. The method as recited in claim 12, wherein the mock cable pattern is a double cable pattern, and which further comprises repeating the tuck stitch forming, transferring, placing and knitting-in steps until a desired length of the mock double cable pattern is formed.

22. The method as recited in claim 1, wherein the tuck stitch is knitted into the fabric at an intermediate point of the formed mock cable portion.

23. The method as recited in claim 7, wherein the portion of the mock single cable pattern being formed is of a serpentine configuration and the tuck stitch is knitted into the fabric essentially at a center point of the formed mock cable portion.

24. The method as recited in claim 1, wherein the mock cable pattern is a single cable pattern, and which further comprises repeating the tuck stitch forming, transferring, placing and knitting-in steps until a desired length of the mock single cable pattern is formed.

25. A method of forming a raised pattern portion in a knitted fabric while knitting the fabric, which comprises the steps of:

forming at least one tuck stitch in advance of a preselected fabric row in which the raised pattern portion is to originate;

further knitting the fabric until the preselected fabric row is reached;

then transferring the tuck stitch to, and placing the tuck stitch on, a preselected knitting needle in said preselected fabric row; and then knitting the preselected fabric row to knit the tuck stitch into the fabric and to form the raised pattern portion in the fabric.

26. The method as recited in claim 25, which further comprises the additional steps of:

forming a second tuck stitch in the fabric in advance of said preselected fabric row in which the raised pattern portion is to originate;

after knitting the fabric until the preselected fabric row is reached, also transferring the second tuck stitch to, and placing the second tuck stitch on, a different preselected knitting needle in said preselected fabric row; and then also knitting the second tuck stitch into the fabric to form another raised pattern portion in the fabric.

27. The method as recited in claim 25, in which the knitting and tuck stitch forming steps are performed using a semi-automatic knitting machine, and the tuck stitch transferring step is performed manually.

* * * * *